US011457757B2

(12) United States Patent
Moore et al.

(10) Patent No.: US 11,457,757 B2
(45) Date of Patent: Oct. 4, 2022

(54) CLOTHING HANGER

(71) Applicant: Lou Hansell, LLC, Elkhart, IN (US)

(72) Inventors: Tim Moore, Belfast (GB); Carsten Astheimer, Claverdon (GB)

(73) Assignee: Lou Hansell, LLC, Elkhart, IN (US)

( * ) Notice: Subject to any disclaimer, the term of this patent is extended or adjusted under 35 U.S.C. 154(b) by 378 days.

(21) Appl. No.: 16/669,699

(22) Filed: Oct. 31, 2019

(65) Prior Publication Data

US 2020/0128988 A1 Apr. 30, 2020

Related U.S. Application Data

(60) Provisional application No. 62/753,341, filed on Oct. 31, 2018.

(51) Int. Cl.
*A47G 25/28* (2006.01)
*A47G 25/48* (2006.01)

(52) U.S. Cl.
CPC ..... *A47G 25/28* (2013.01); *A47G 25/48* (2013.01)

(58) Field of Classification Search
CPC ..... A47G 25/12–22; A47G 25/26–32; A47G 25/36–40; A47G 25/48; A47G 25/1485; A47G 25/1492; A47G 25/52; A47G 25/4046; A47G 25/4053; A47G 25/4076
See application file for complete search history.

(56) References Cited

U.S. PATENT DOCUMENTS 1,453,000 A 4/1923 Brinkman
1,682,626 A * 8/1928 Peckham ..... A47G 25/4023 223/89
2,120,436 A * 6/1938 Fallot ..... A47G 25/4053 211/118
2,637,471 A * 5/1953 Goldschmidt ..... A47G 25/442 223/89
2,722,351 A * 11/1955 Francis ..... A47G 25/442 223/89
2,900,117 A 8/1959 Veltry
3,537,625 A * 11/1970 Nuttall ..... A47G 25/743 223/85
4,168,791 A 9/1979 Clark, Jr.
4,717,053 A 1/1988 Wang
5,085,357 A 2/1992 Chen
(Continued)

FOREIGN PATENT DOCUMENTS

CA 2450873 A1 5/2005
CN 106798473 A 6/2017
(Continued)

OTHER PUBLICATIONS

European Patent Office, International Search Report issued in PCT/US2019/059022, dated Feb. 12, 2020, 6 pages.
(Continued)

*Primary Examiner* — Ismael Izaguirre
(74) *Attorney, Agent, or Firm* — Barnes & Thornburg LLP

(57) ABSTRACT

A clothing hanger includes a base member, a rotatable hook connectable to the base member, first and second arm members connectable to the base member, first and second support members connectable to the first and second arm members, and first and second support cover members connectable to the first and second support members.

27 Claims, 22 Drawing Sheets

(56) References Cited

U.S. PATENT DOCUMENTS

| | | | | |
|---|---|---|---|---|
| 5,417,352 | A * | 5/1995 | Jen | A47G 25/32 223/85 |
| D360,306 | S | 7/1995 | Hodzen | |
| 5,503,311 | A | 4/1996 | Chen | |
| 5,520,311 | A | 5/1996 | Lam | |
| D407,909 | S | 4/1999 | Pfutzenreuter | |
| 6,065,653 | A * | 5/2000 | Lin | A47G 25/20 223/94 |
| 6,964,360 | B2 * | 11/2005 | Tubman | A47G 25/442 223/85 |
| 7,837,074 | B2 | 11/2010 | Rude et al. | |
| 8,113,393 | B2 | 2/2012 | Ho | |
| 8,152,034 | B2 * | 4/2012 | Chang | D21J 3/00 223/87 |
| 8,381,952 | B2 | 2/2013 | Mainetti | |
| 8,899,454 | B2 | 12/2014 | Mainetti | |
| 8,991,666 | B2 | 3/2015 | Mazyck | |
| 9,113,736 | B1 | 8/2015 | Antler | |
| D738,119 | S | 9/2015 | Buzruk et al. | |
| 9,247,838 | B2 | 2/2016 | Kallet | |
| 9,314,123 | B1 | 4/2016 | Schlang | |
| 9,380,902 | B2 | 7/2016 | Kirkwood | |
| 9,445,679 | B2 | 9/2016 | Hansen et al. | |
| 9,655,466 | B1 | 5/2017 | Bernstein et al. | |
| 9,820,599 | B1 | 11/2017 | Goldman et al. | |
| D806,409 | S | 1/2018 | Schapiro | |
| 2004/0079772 | A1 * | 4/2004 | Shih | A47G 25/442 223/85 |
| 2005/0115993 | A1 * | 6/2005 | Miura | A47G 25/20 223/98 |
| 2010/0038388 | A1 | 2/2010 | Munro | |
| 2012/0118921 | A1 * | 5/2012 | MacKenzie | A47G 25/38 223/85 |
| 2016/0235233 | A1 | 8/2016 | Apelbaum et al. | |
| 2018/0303263 | A1 | 10/2018 | Jones et al. | |

FOREIGN PATENT DOCUMENTS

| | | | |
|---|---|---|---|
| DE | 9407762.2 | U1 | 8/1994 |
| DE | 29514501 | U1 | 11/1995 |
| DE | 19860605 | A1 * | 7/2000 |
| EP | 1498054 | A2 | 1/2005 |
| EP | 2294950 | A1 | 3/2011 |
| EP | 2389847 | A1 | 11/2011 |
| EP | 3222171 | A1 | 9/2017 |
| FR | 2667233 | A1 | 4/1992 |
| GB | 813412 | | 5/1959 |
| GB | 2430870 | A | 4/2007 |
| KR | 20-20090007444 | U | 7/2009 |
| KR | 101312030 | | 9/2013 |
| KR | 1020180012521 | | 2/2018 |
| KR | 1020180053580 | | 5/2018 |
| WO | 2018151764 | A1 | 8/2018 |

OTHER PUBLICATIONS

European Patent Office, Written Opinion issued in PCT/US2019/059022, dated Feb. 12, 2020, 9 pages.

* cited by examiner

CLOTHING HANGER

BACKGROUND OF THE INVENTION

The present invention relates to clothing hangers and to a system of clothing hangers in which the individual hangers are configured for use with different garment types.

BACKGROUND AND SUMMARY OF THE INVENTION

In one embodiment of the present invention, a clothing hanger includes a base member having a first arm having a first end and a second end, a second arm having a first end connected to the first end of the first arm and a second end, a third arm having a first end connected to the second end of the first arm and a second end connected to the second end of the second arm, a first mounting structure adjacent the first end of the first arm and the first end of the second arm, a second mounting structure adjacent the second end of the first arm and the first end of the third arm and a third mounting structure adjacent the second end of the second arm and the second end of the third arm. The first mounting structure includes a surface and a post extending from the surface. The second and third mounting structures each include an opening. The hanger further includes a hook having a mounting structure for engaging the first mounting structure of the base member and selectively securing the hook to the base member in multiple orientations with respect to the base member. The mounting structure of the hook includes a surface having an opening for receiving the post of the first mounting structure such that the hook is rotatable about the post. The hanger further includes a first arm member having a first end having a projection extending therefrom for engaging the opening in the second mounting structure to secure the first arm to the base member, and a second arm member having a first end having a projection extending therefrom for engaging the opening in the third mounting structure to secure the second arm to the base member.

In one embodiment, the hanger further includes an opening in the first arm member, a first support member having a projection for engaging the opening in the first arm member to secure the first support member to the first arm member, an opening in the second arm member, a second support member having a projection for engaging the opening in the second arm member to secure the second support member to the second arm member, an opening in the first support member, a first support cover member having a projection for engaging the opening in the first support member to secure the first support cover member to the first support member, an opening in the second support member, and a second support cover member having a projection for engaging the opening in the second support member to secure the second support cover member to the second support member.

In another embodiment of the present invention, a clothing hanger includes a base member having a first arm having a first end and a second end, a second arm having a first end connected to the first end of the first arm and a second end, and a third arm having a first end connected to the second end of the first arm and a second end connected to the second end of the second arm, a first mounting structure adjacent the first end of the first arm and the first end of the second arm, a second mounting structure adjacent the second end of the first arm and the first end of the third arm, and a third mounting structure adjacent the second end of the second arm and the second end of the third arm. The hanger further includes a hook having a mounting structure for engaging the first mounting structure of the base member and securing the hook to the base member. The hanger also includes a first arm member having a first end and a second end and a second arm member having a first end and a second end. The first end of the first arm member is configured to engage the second mounting structure of the base member to secure the first arm member to the base member and the first end of the second arm member is configured to engage the third mounting structure of the base member to secure the second arm member to the base member.

In one embodiment, the first mounting structure includes a surface having a post extending therefrom. In another embodiment, the mounting structure of the hook includes a surface having an opening for receiving the post of the first mounting structure. In certain embodiments, the post includes a retaining member. In other embodiments, the mounting structure of the hook has a first section having a first diameter and a second section having a second diameter differing from the first diameter and the second section receives the retaining member when the hook is connected to the base member. In one embodiment, the hook is rotatable about the post. In certain embodiments, the surface of the first mounting structure includes a projection and the mounting structure of the hook includes a recess for receiving the projection to resist rotation of the hook about the post. In other embodiments, the surface of the first mounting structure includes a plurality of projections and the mounting structure of the hook includes a plurality of recesses for receiving the projections to selectively position the hook in a plurality or orientations with respect to the base member.

In another embodiment, the second mounting structure of the base member includes an opening and the first end of the first arm member includes a projection for engaging the opening to connect the first arm member to the base member. In some embodiments, the second mounting structure and the projection for engaging the opening in the second mounting structure are configured so as to permit the first arm member to be connected to the base member in only one orientation. In other embodiments, the opening in the second mounting structure and the projection for engaging the opening in the second mounting structure are configured so as to prevent rotation of the first arm member when the first arm member is connected to the base member.

In another embodiment, the hanger further includes a rod having a first end with an opening therein and the second end of the first arm member includes a projection configured to engage the opening in the first end of the rod to secure the rod to the first arm member. In some embodiments, the opening in the rod and the projection for engaging the opening in the rod are configured so as to prevent rotation of the rod when the rod is connected to the first arm member.

In another embodiment, the hanger further includes an opening in the first arm member and a support member having a projection for engaging the opening in the first arm member to secure the support member to the first arm member. In certain embodiments, the hanger further includes an opening in the support member and a support cover member having a projection for engaging the opening in the support member to secure the support cover member to the support member.

In another embodiment of the present invention, a clothing hanger includes a base member, a first arm member, a second arm member, a first support member, a second support member, a first support cover member, a second support cover member and a hook. The hanger further includes first means for connecting the first arm member to the base member, second means for connecting the second arm member to the base member, third means for connecting the first support member to the first arm member, fourth means for connecting the second support member to the second arm member, fifth means for connecting the first support cover member to the first support member, sixth means for connecting the second support cover member to the second support member and seventh means for connecting the hook to the base member.

These and other features of the present invention will be apparent to those skilled in the art from the following detailed description of embodiments of the invention and accompanying drawings.

DETAILED DESCRIPTION OF EMBODIMENTS OF THE INVENTION

Figure 1:
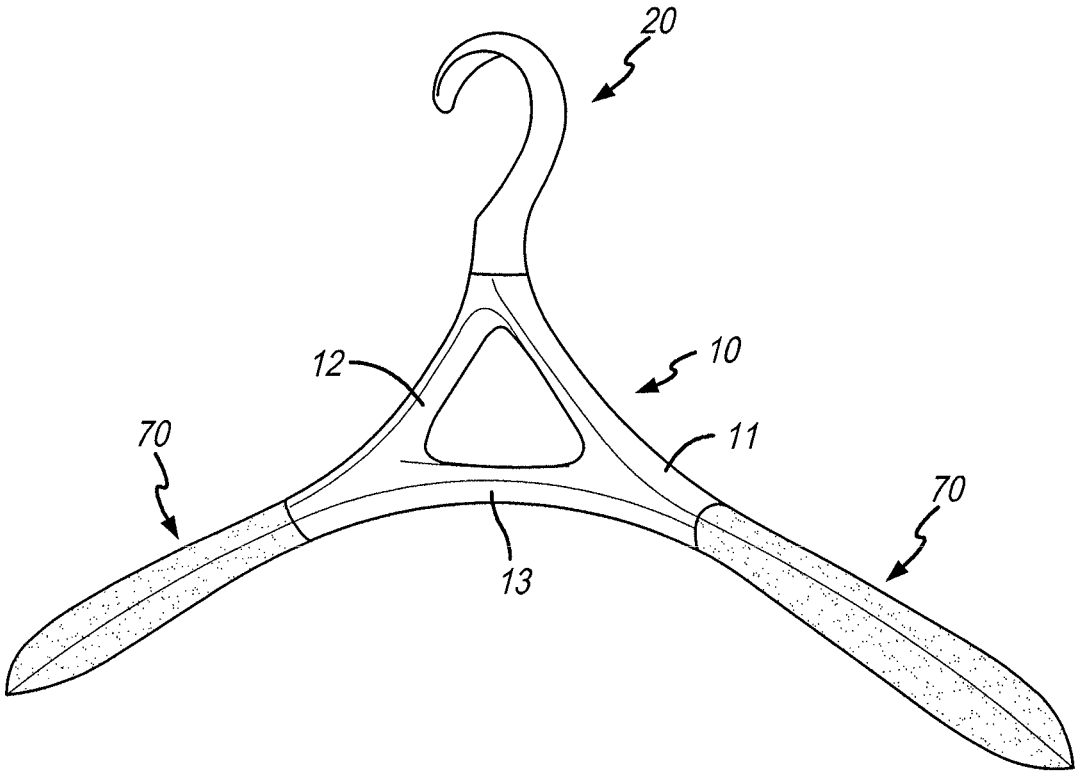
FIG. 1 is a perspective view of a clothing hanger according to one embodiment of the present invention.
Figure 2:
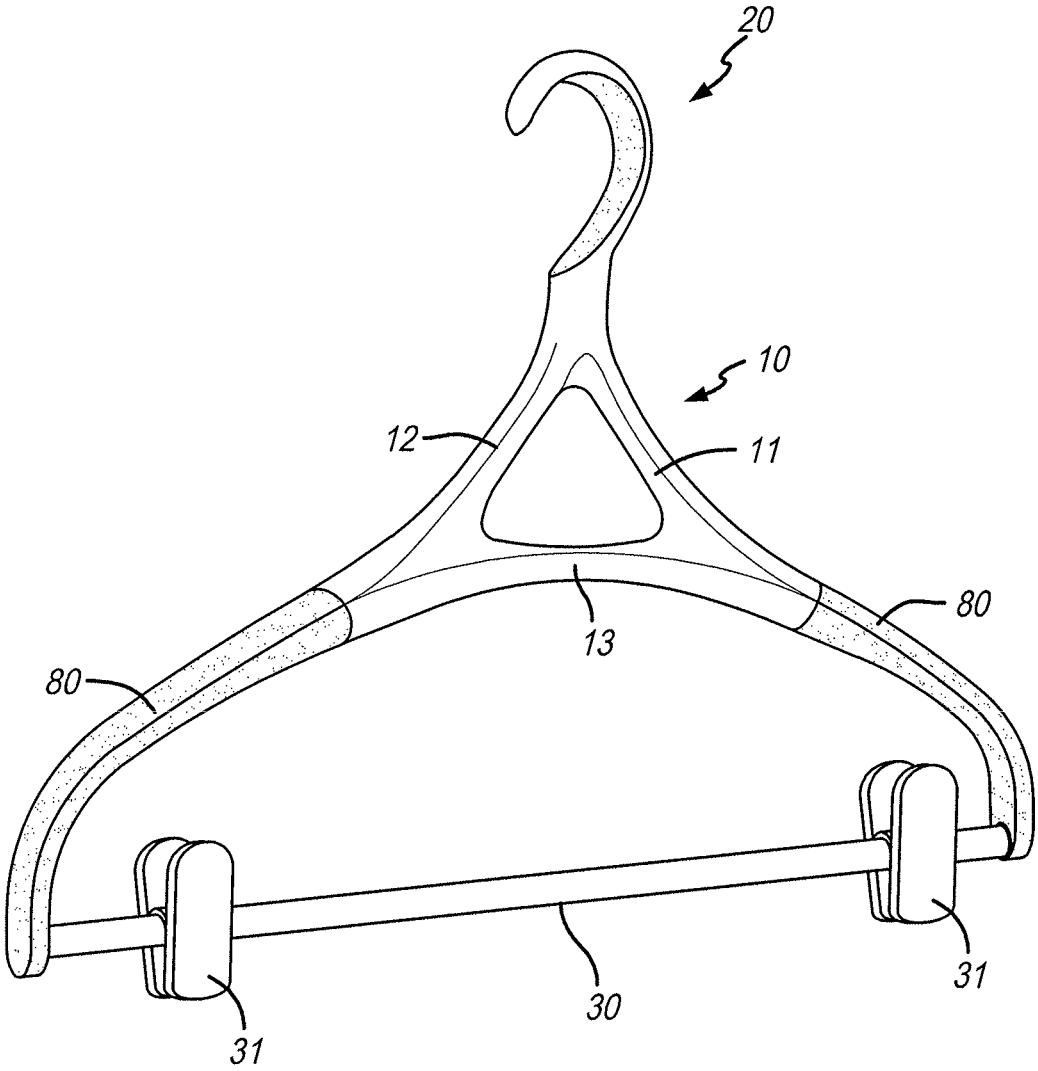
FIG. 2 is a perspective view of a clothing hanger according to another embodiment of the present invention.
Figure 3:
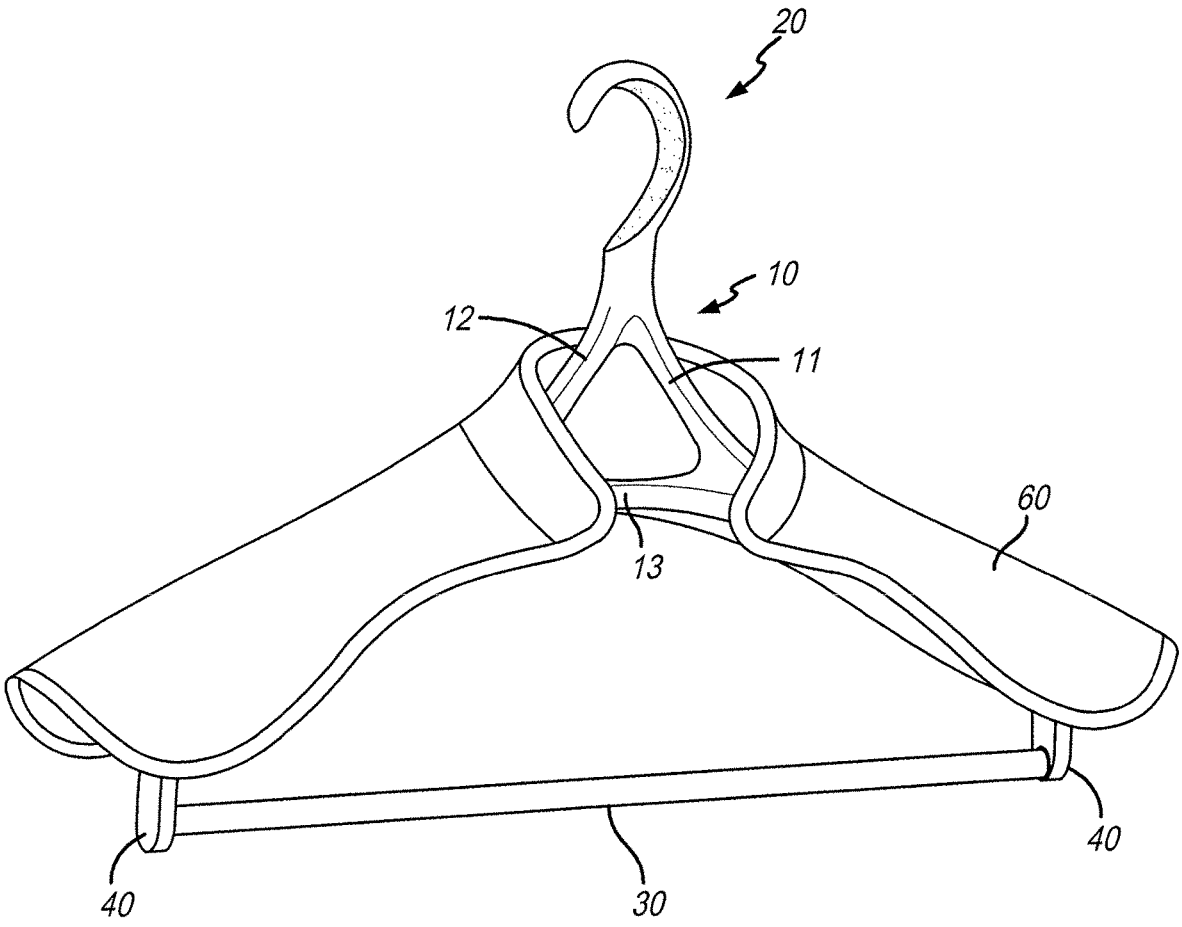
FIG. 3 is a perspective view of a clothing hanger according to another embodiment of the present invention.
Figure 4:
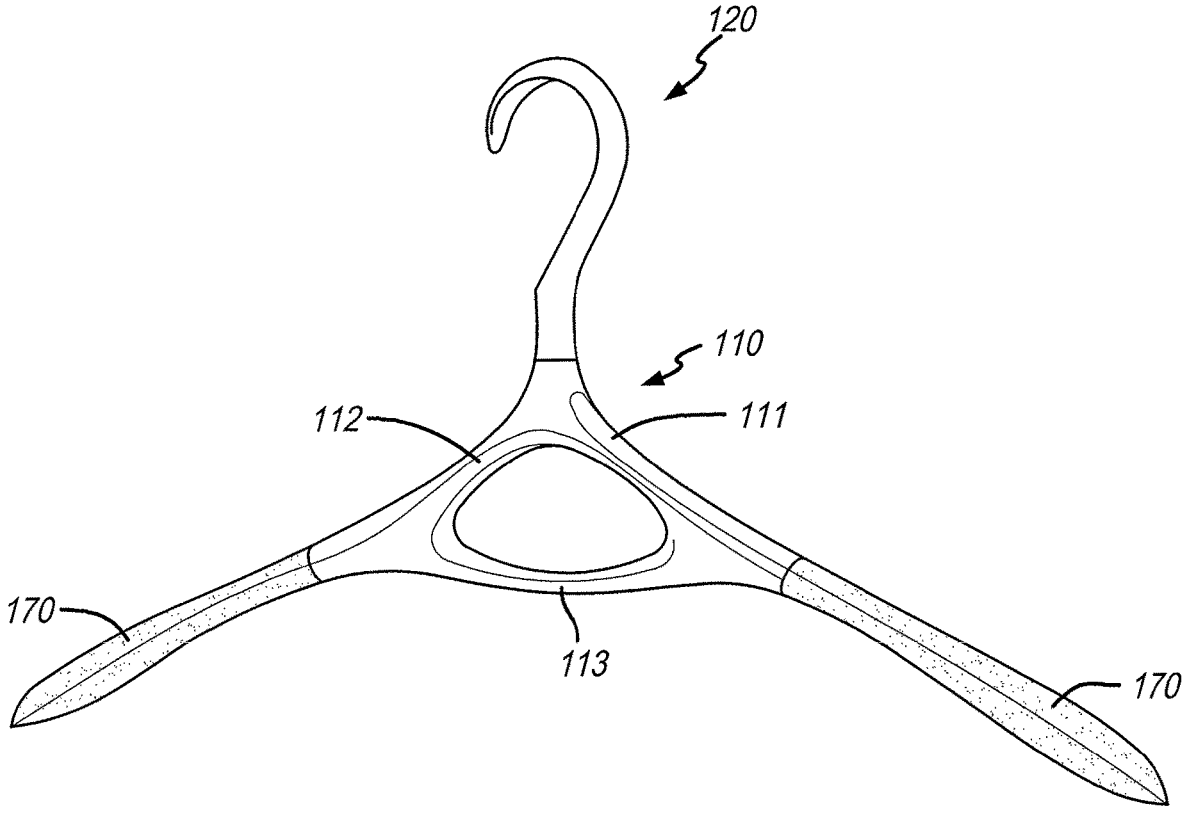
FIG. 4 is a perspective view of a clothing hanger according to another embodiment of the present invention.
Figure 5:
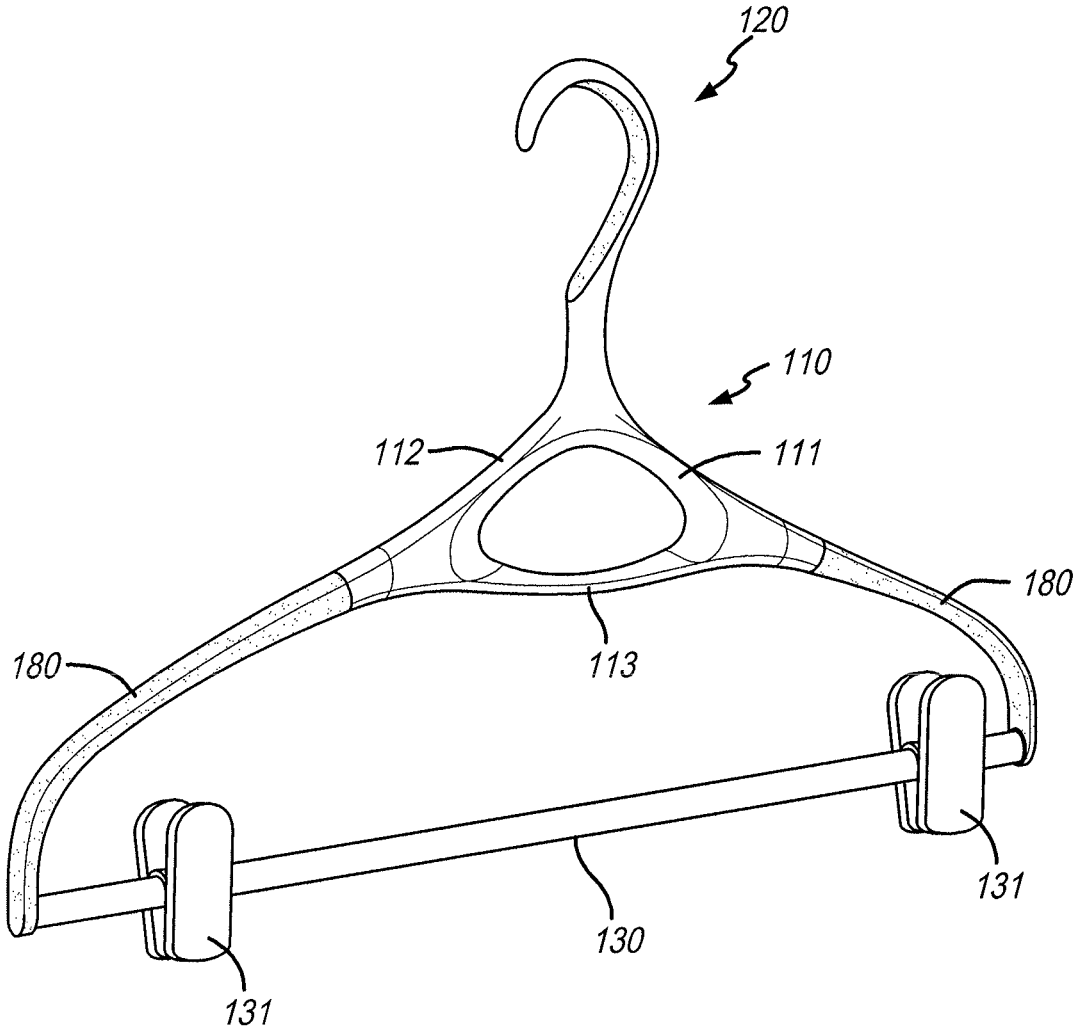
FIG. 5 is a perspective view of a clothing hanger according to another embodiment of the present invention.
Figure 6:
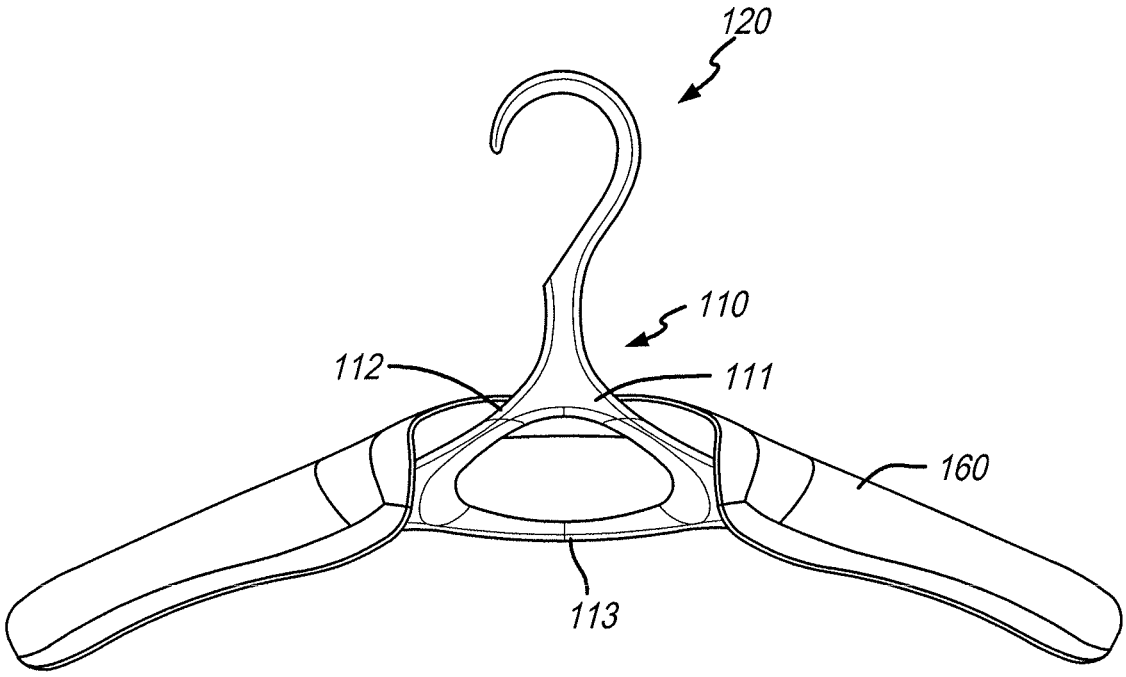
FIG. 6 is a perspective view of a clothing hanger according to another embodiment of the present invention.
Figure 7A:
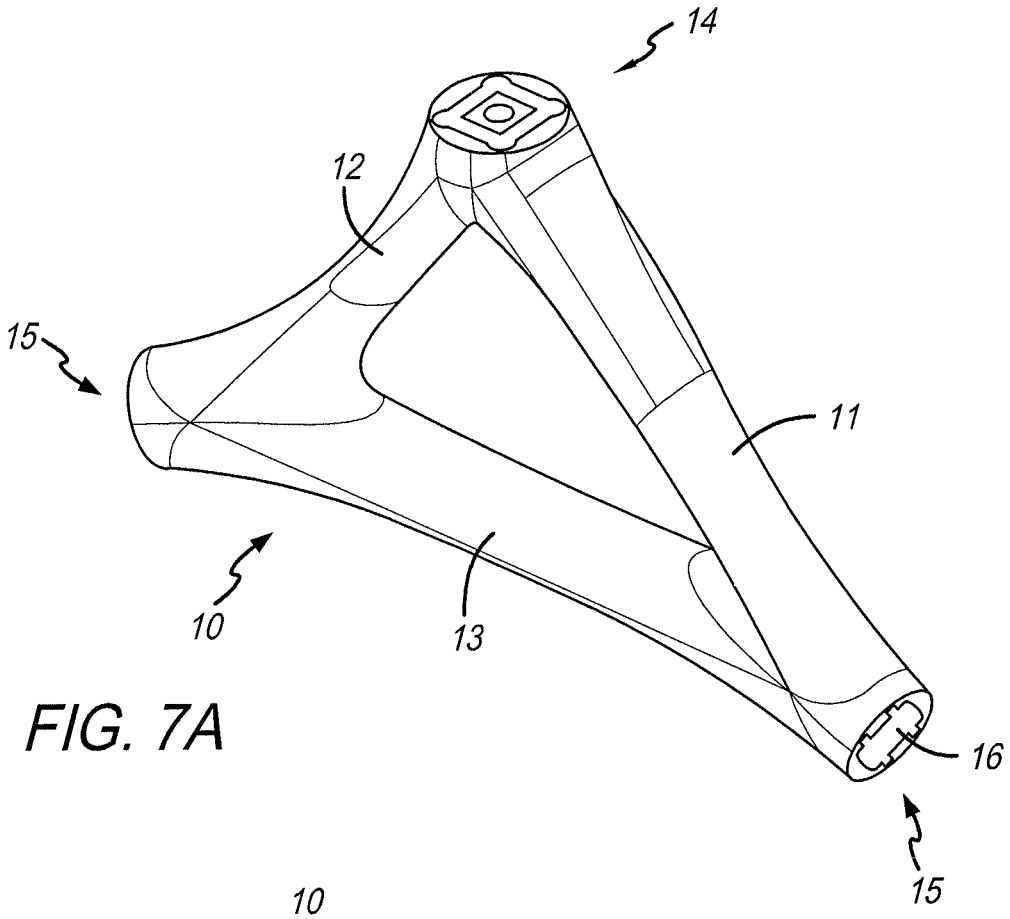
FIG. 7A is a perspective view of a base member that is a component of the clothing hangers shown in FIGS. 1-3.
Figure 7B:
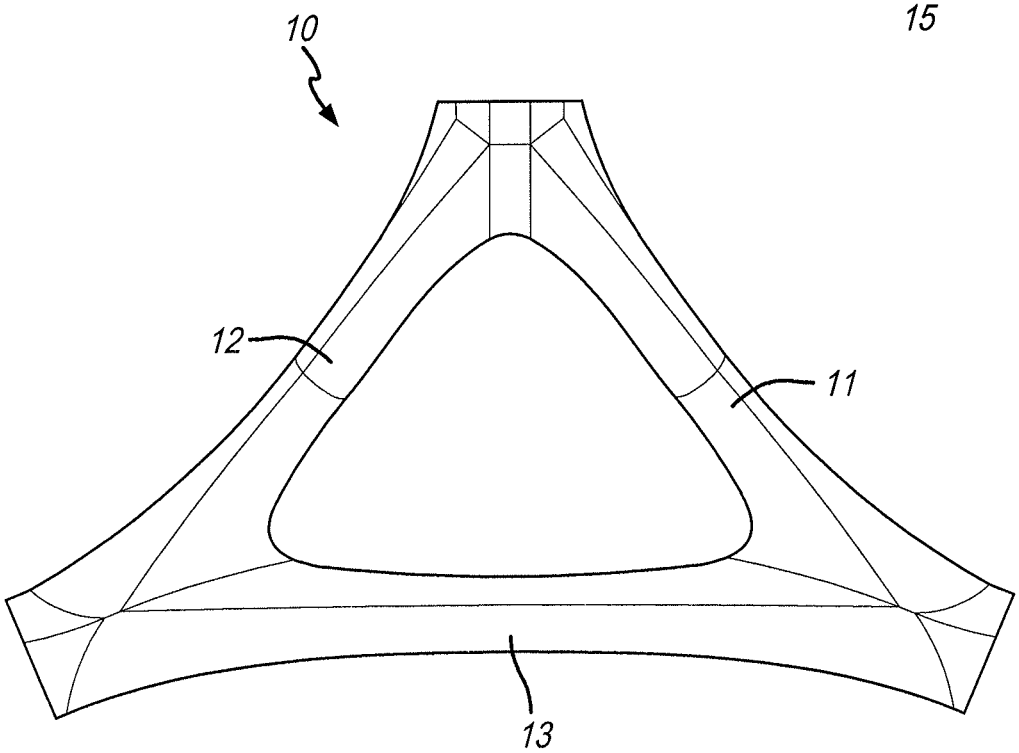
FIG. 7B is a front elevational view of the base member shown in FIG. 7A.
Figure 7C:
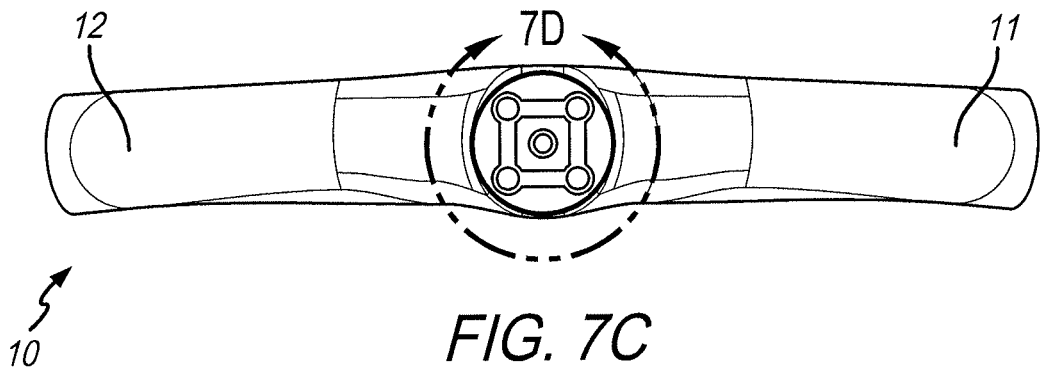
FIG. 7C is a top plan view of the base member shown in FIG. 7A.
Figure 7D:
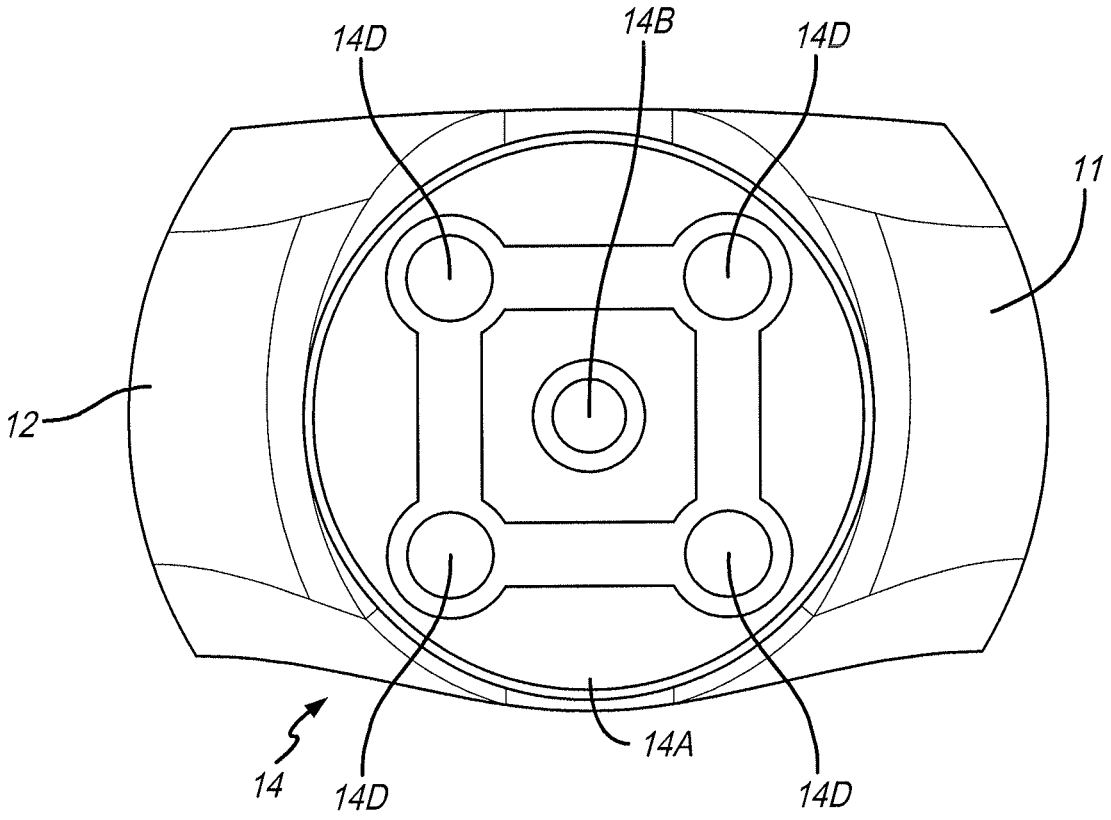
FIG. 7D is an enlarged view of the area shown in detail 7D in FIG. 7C.

FIGS. 1-6 are perspective views of clothing hangers according to embodiments of the present invention. The clothing hangers illustrated in FIGS. 1-3 are intended primarily for use with various items of men's clothing. The clothing hangers illustrated in FIGS. 4-6 are intended primarily for use with various items of women's clothing.

Figure 8:
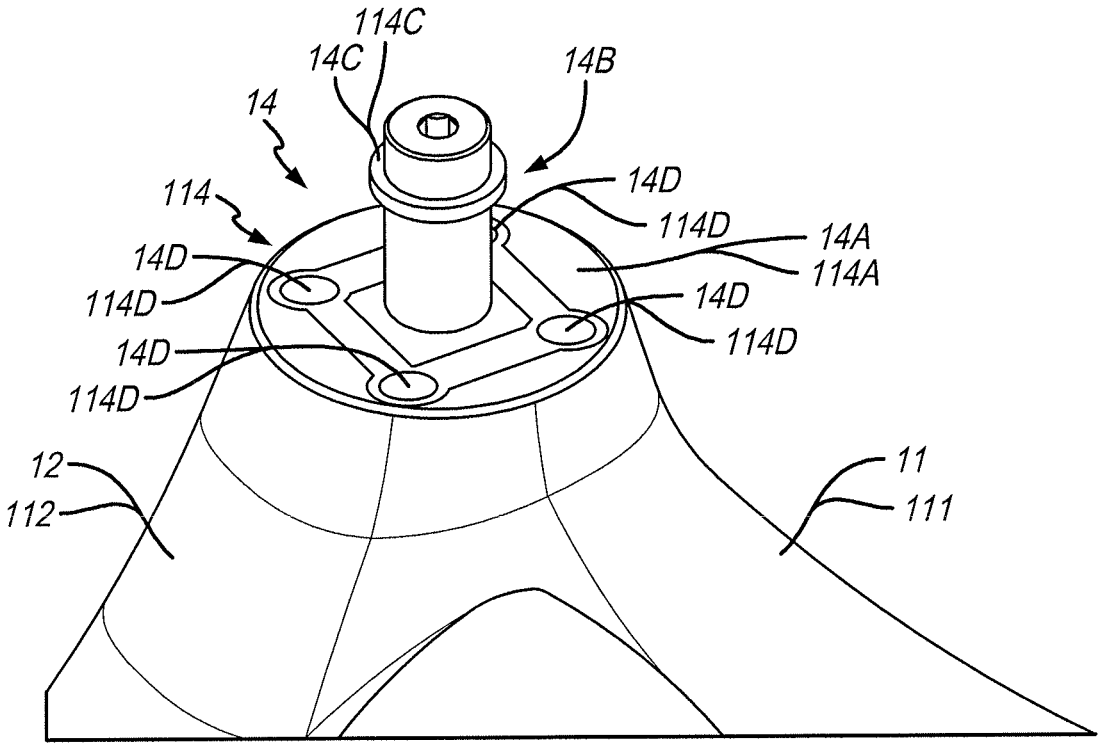
FIG. 8 is a perspective view of a mounting structure that is a portion of the base members shown in FIGS. 7 and 13.

FIGS. 7A-7D illustrate various views of a base member 10 that is a component of the clothing hangers shown in FIGS. 1-3. In the embodiment shown, base member 10 has a generally triangular configuration and includes a first arm 11, a second arm 12 and a third arm 13. Arms 11 and 12 meet at one end thereof at a mounting structure 14 for connecting a hook to base member 10, as described in greater detail below. Mounting structure 14 generally includes an upper surface 14A having a post 14B extending therefrom (FIG. 8). Post 14B, in the embodiment shown, includes a retaining member 14C of wider diameter than the remainder of post 14B. Upper surface 14 further includes a plurality of projections 14D extending therefrom. In the embodiment shown, there are four projections 14D. Projections 14D may be stationary members or may be moveable members, such as ball bearings.

The ends of first arm 11 and second arm 12 opposite mounting structure 14 each join with third arm 13 at a mounting structure 15 for connecting various arm members to base member 10, as described in greater detail below. Each mounting structure 15 includes an opening or recess 16 therein for receiving one end of various arm members. In the embodiment shown, opening or recess 16 is keyed or otherwise provided with structures designed to properly orient the various arm members with respect to base member 10 and to prevent rotation of the various arm members relative to base member 10, as described below.

Figure 9A:
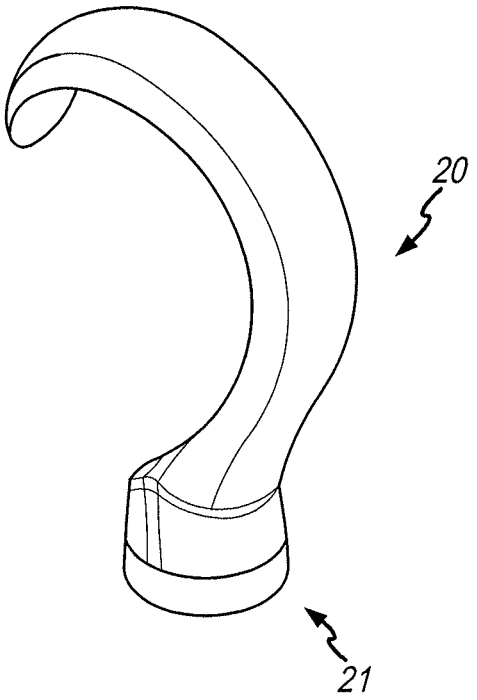
FIG. 9A is a perspective view of a hook that is a component of the clothing hangers shown in FIGS. 1-3.
Figure 9B:
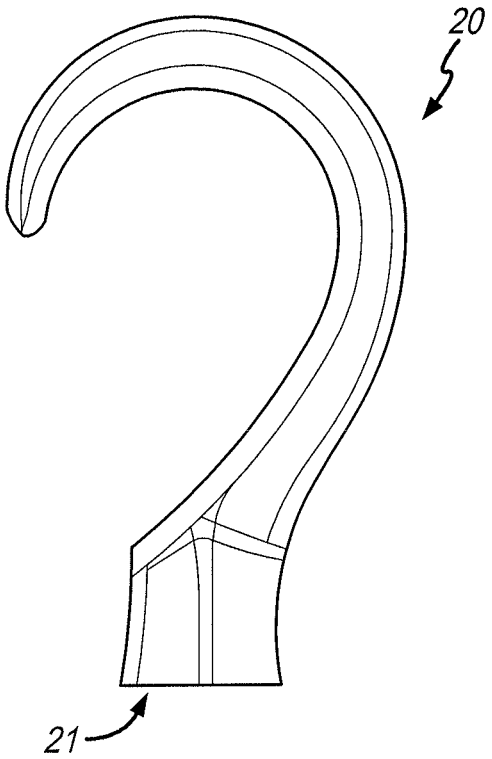
FIG. 9B is a front elevational view of the hook shown in FIG. 9A.
Figure 9C:
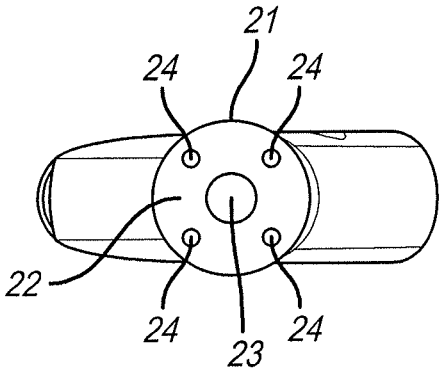
FIG. 9C is a bottom plan view of the hook shown in FIG. 9A.
Figure 10A:
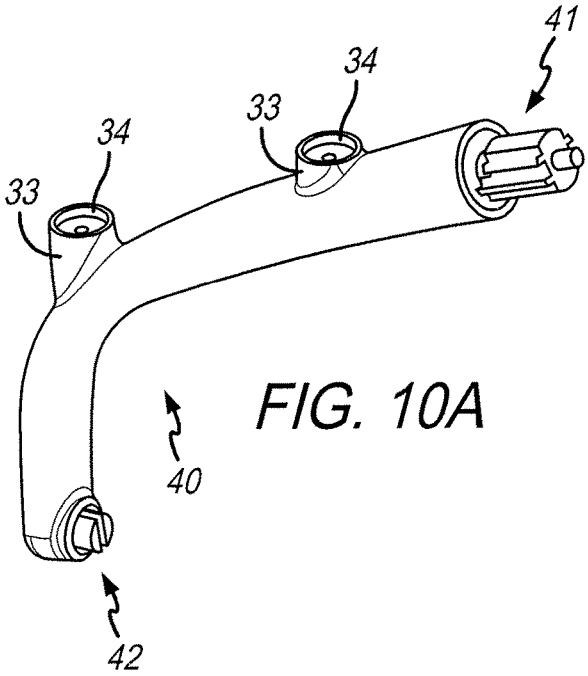
FIG. 10A is a perspective view of an arm member that is a component of the clothing hanger shown in FIG. 3.
Figure 10B:
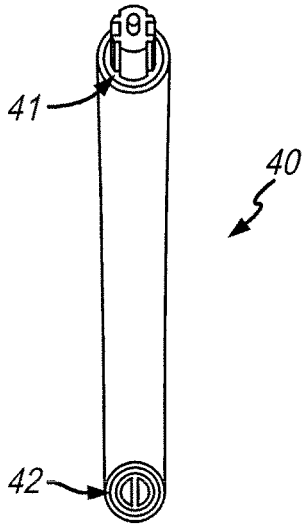
FIG. 10B is a right side elevational view of the arm member shown in FIG. 10A.
Figure 10C:
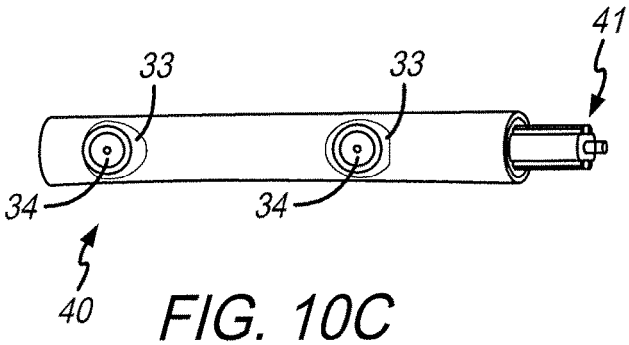
FIG. 10C is a top plan view of the arm member shown in FIG. 10A.
Figure 10D:
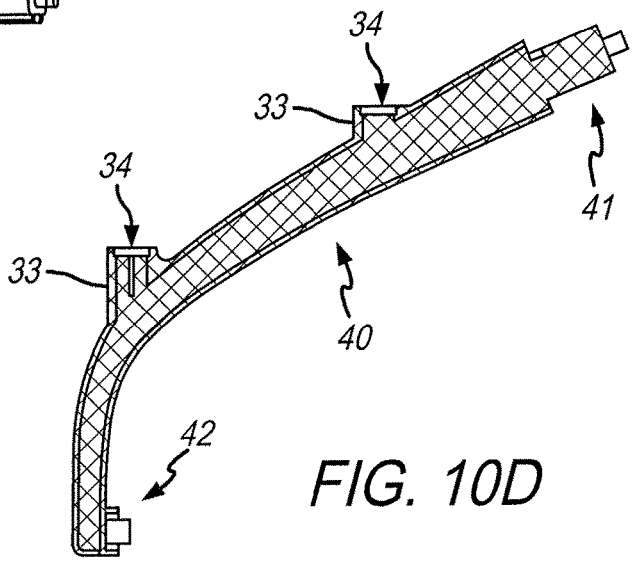
FIG. 10D is a cross-sectional view of the arm member shown in FIG. 10A.
Figure 11A:
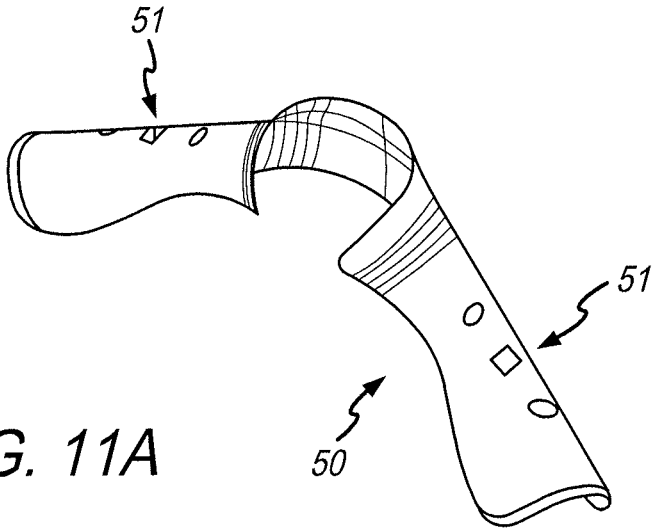
FIG. 11A is a perspective view of a skin support member that is a component of the clothing hanger shown in FIG. 3.
Figure 11B:
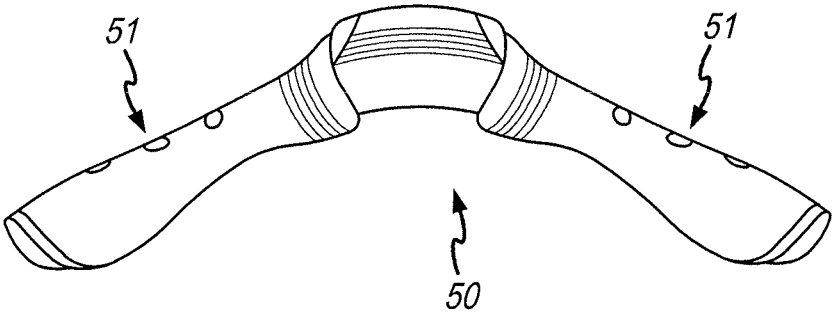
FIG. 11B is a front elevational view of the skin support member shown in FIG. 11A.
Figure 11C:
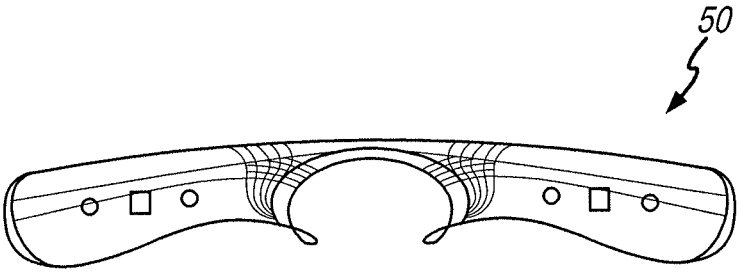
FIG. 11C is a top plan view of the skin support member shown in FIG. 11C.
Figure 12A:
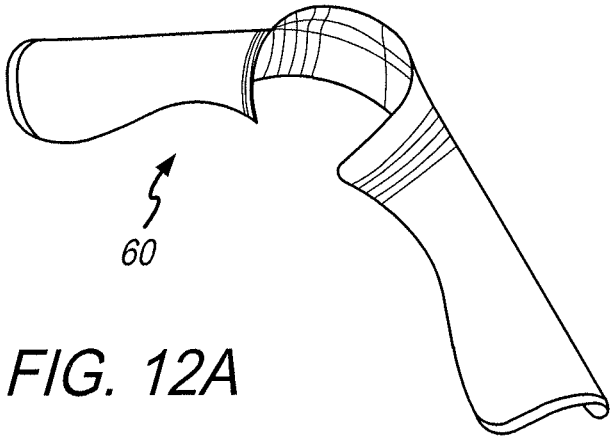
FIG. 12A is a perspective view of a skin support cover member that is a component of the clothing hanger shown in FIG. 3.
Figure 12B:
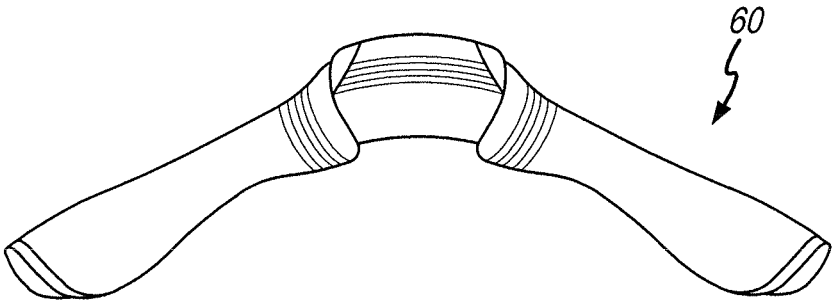
FIG. 12B is a front elevational view of the skin support cover member shown in FIG. 12A.
Figure 12C:
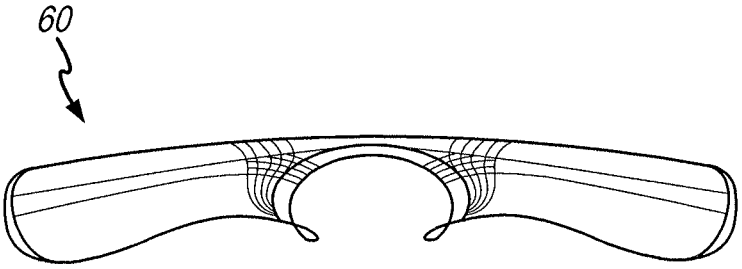
FIG. 12C is a top plan view of the skin support cover member shown in FIG. 12A.
Figure 12D:
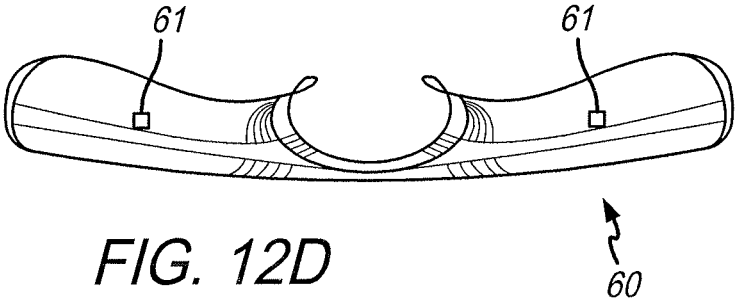
FIG. 12D is a bottom plan view of the skin support cover member shown in FIG. 12A.
Figure 13A:
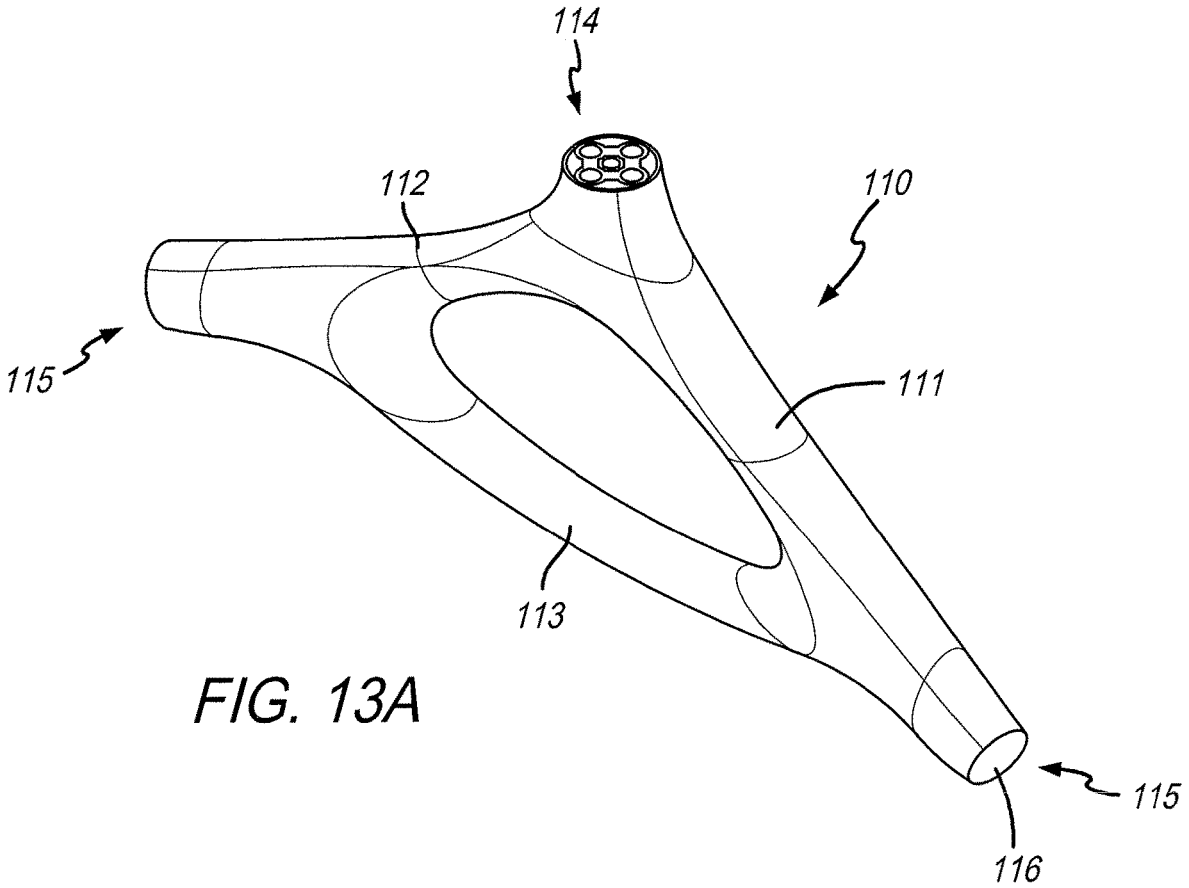
FIG. 13A is a perspective view of a base member that is a component of the clothing hangers shown in FIGS. 4-6.
Figure 13B:
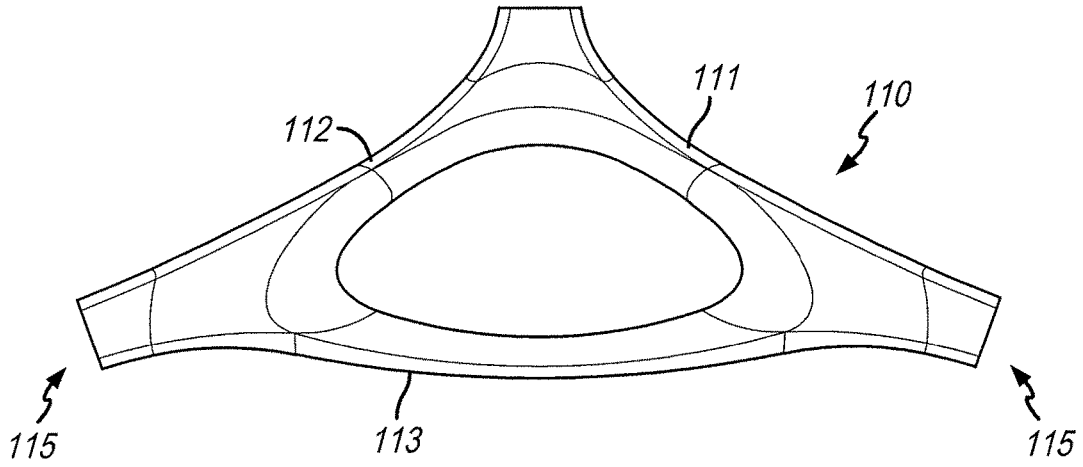
FIG. 13B is a front elevational view of the base member shown in FIG. 13A.
Figure 13C:
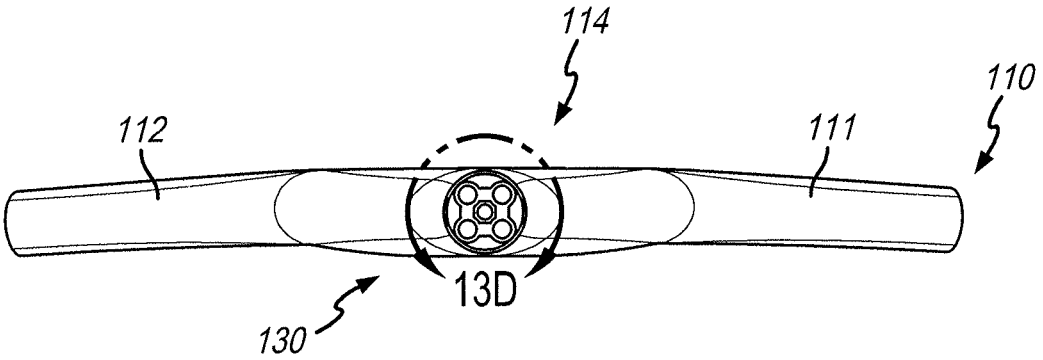
FIG. 13C is a top plan view of the base member shown in FIG. 13A.
Figure 13D:
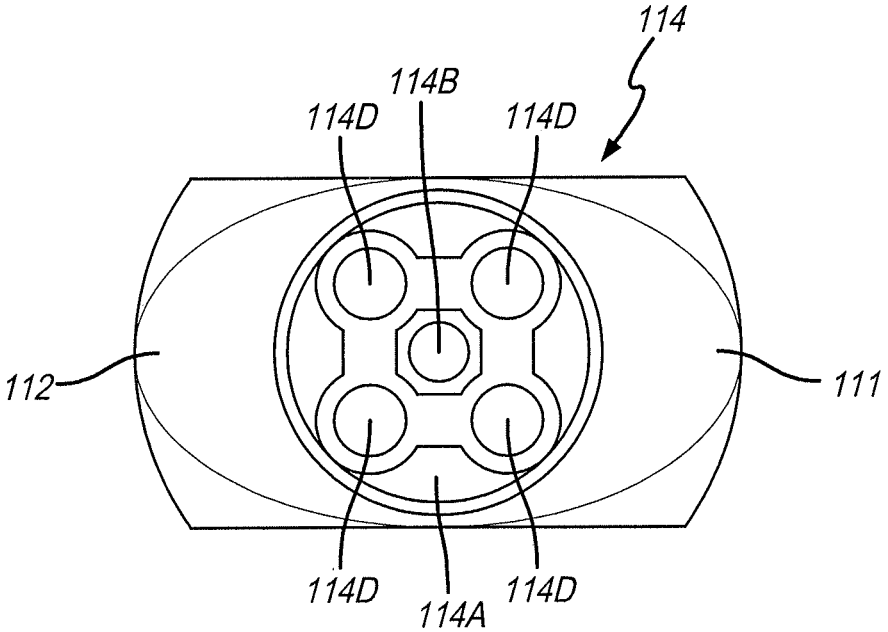
FIG. 13D is an enlarged view of the area shown in detail 13D in FIG. 13C.
Figure 14A:
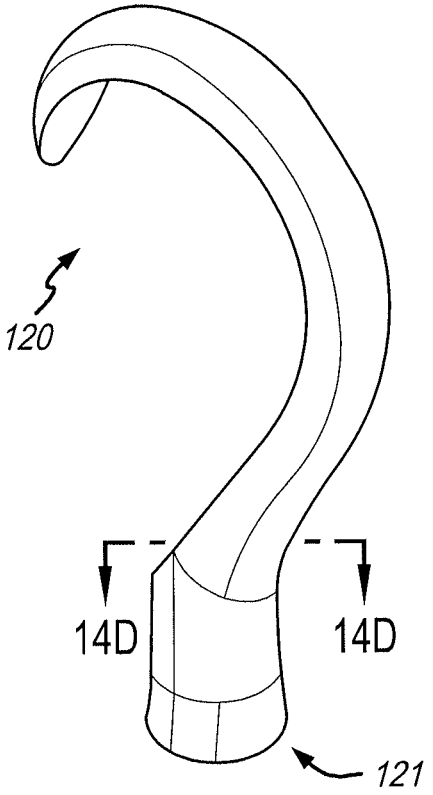
FIG. 14A is a perspective view of a hook that is a component of the clothing hangers shown in FIGS. 4-6.
Figure 14B:
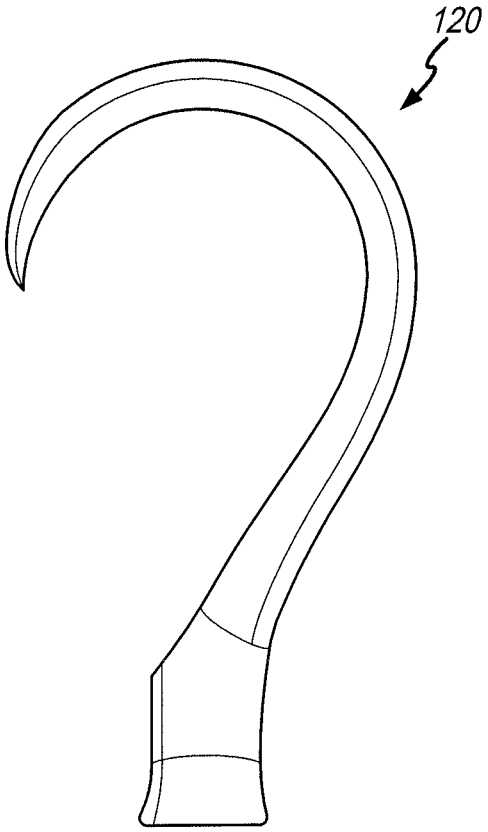
FIG. 14B is a front elevational view of the hook shown in FIG. 14A.
Figure 14C:
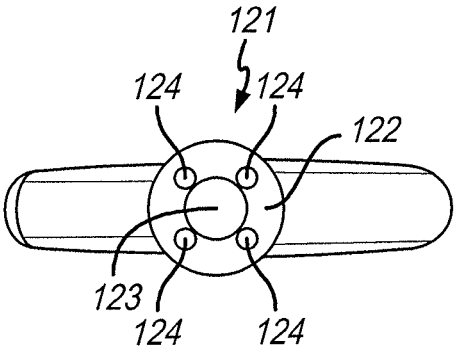
FIG. 14C is a bottom plan view of the hook shown in FIG. 14A.
Figure 14D:
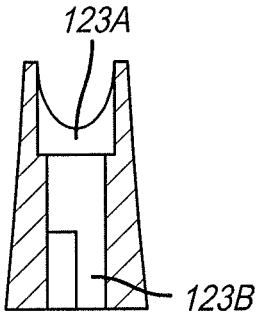
FIG. 14D is a cross sectional view taken along line 14D-14D in FIG. 14A.
Figure 15A:
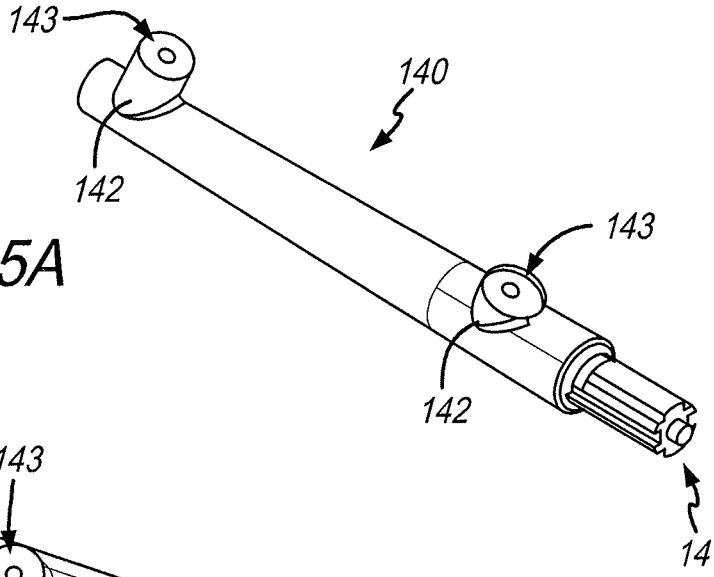
FIG. 15A is a first perspective view of an arm member that is a component of the clothing hanger shown in FIG. 6.
Figure 15B:
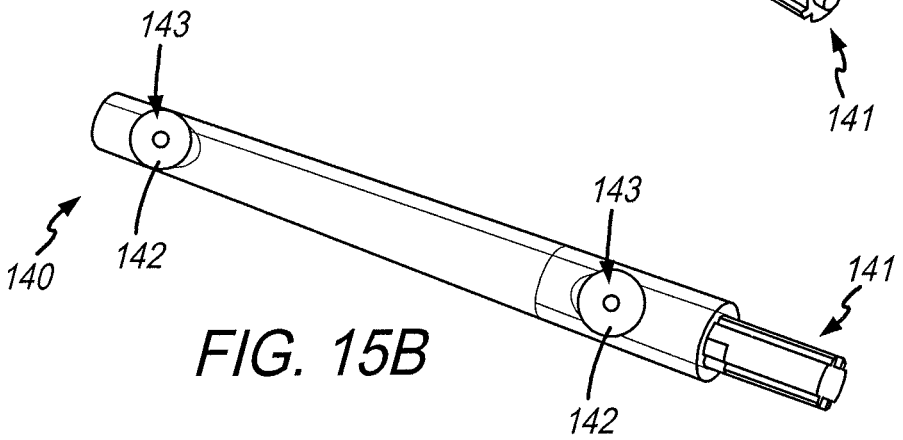
FIG. 15B is a second perspective view of the arm member shown in FIG. 15A.
Figure 15C:
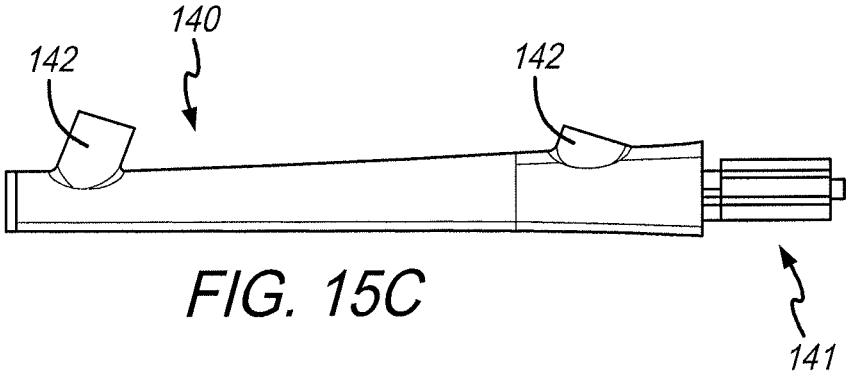
FIG. 15C is a front elevational view of the arm member shown in FIG. 15A.
Figure 15D:
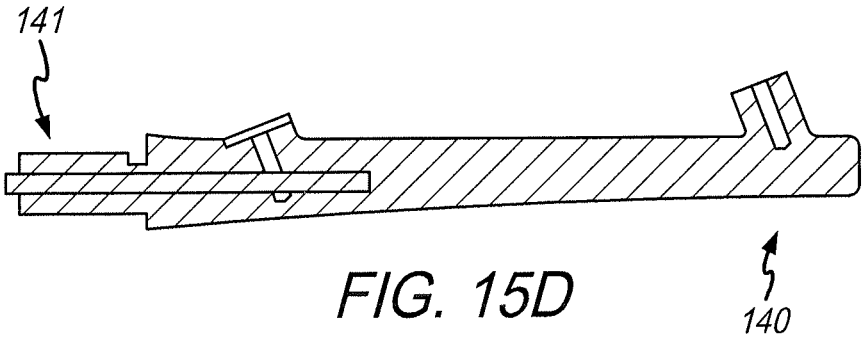
FIG. 15D is a cross-sectional view of the arm member shown in FIG. 15A.
Figure 16A:
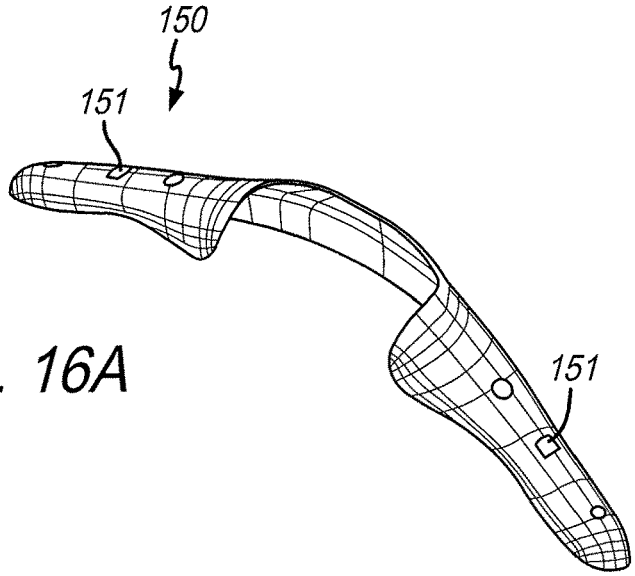
FIG. 16A is a perspective view of a skin support member that is a component of the clothing hanger shown in FIG. 6.
Figure 16B:
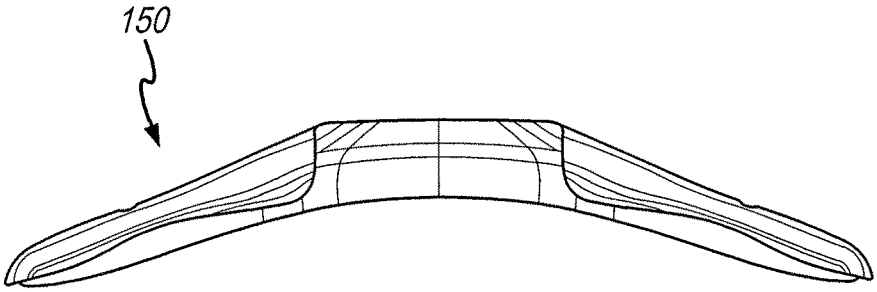
FIG. 16B is a front elevational view of the skin support member shown in FIG. 16A.
Figure 16C:
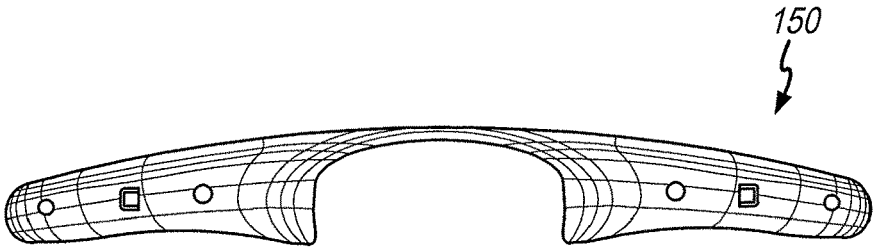
FIG. 16C is a top plan view of the skin support member shown in FIG. 16A.
Figure 16D:
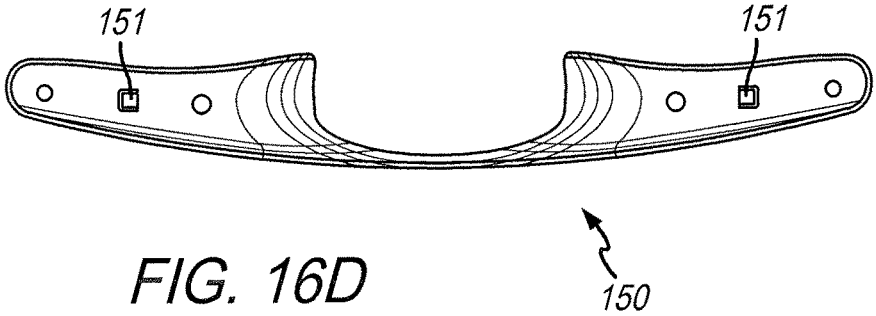
FIG. 16D is a bottom plan view of the skin support member shown in FIG. 16A.
Figure 17A:
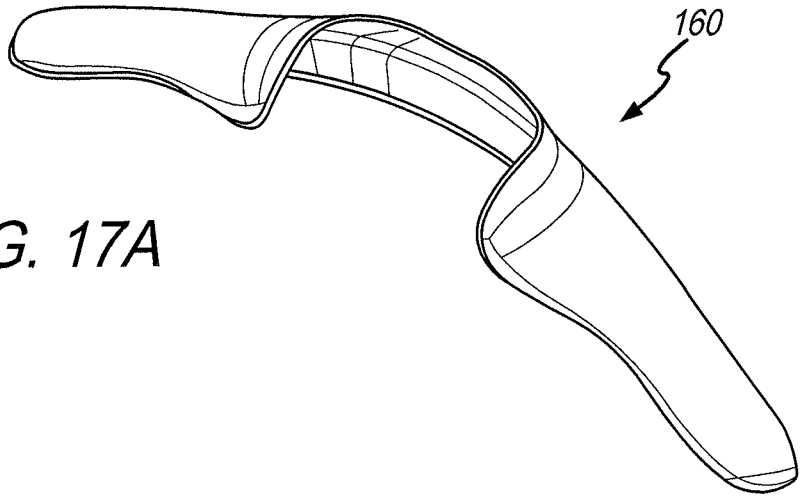
FIG. 17A is a perspective view of a skin support cover member that is a component of the clothing hanger shown in FIG. 6.
Figure 17B:
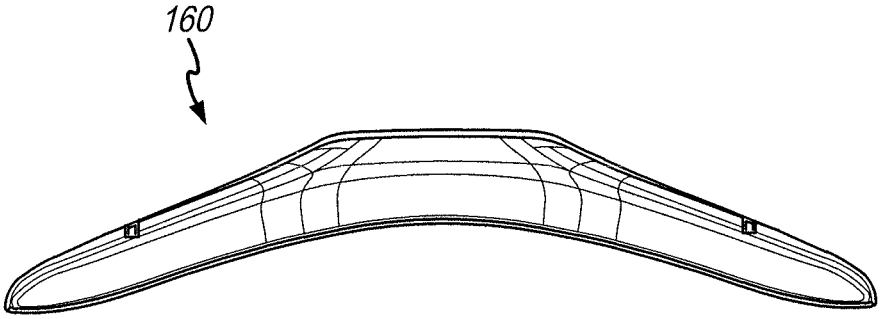
FIG. 17B is a rear elevational view of the skin support cover member shown in FIG. 17A.
Figure 17C:
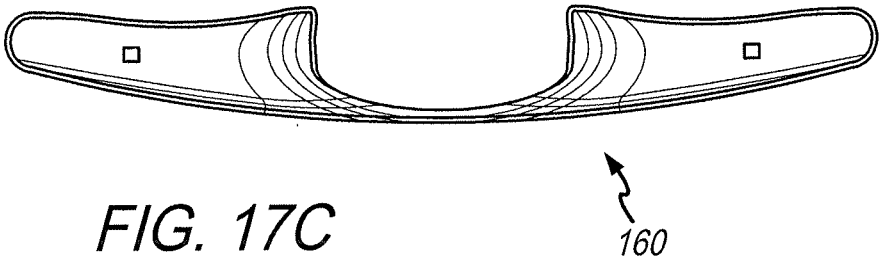
FIG. 17C is a top plan view of the skin support cover member shown in FIG. 17A.
Figure 18A:
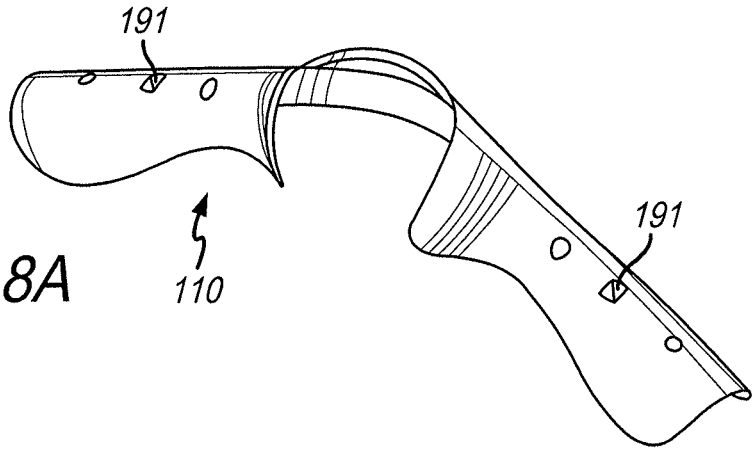
FIG. 18A is a perspective view of a skin support member that is a component of a clothing hanger according to other embodiments of the present invention.
Figure 18B:
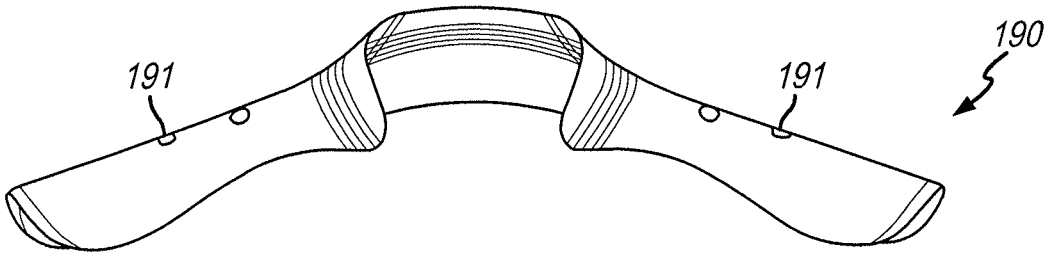
FIG. 18B is a front elevational view of the skin support member shown in FIG. 18A.
Figure 18C:
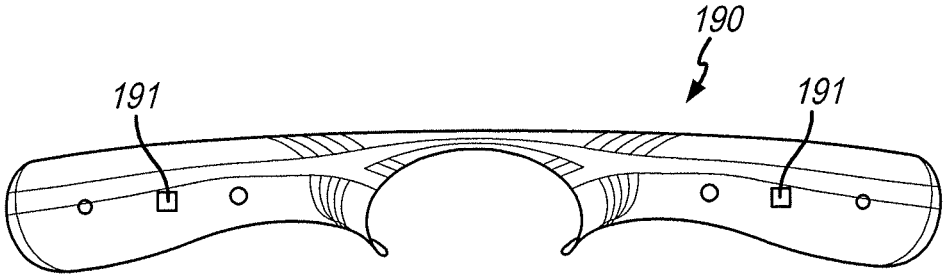
FIG. 18C is a top plan view of the skin support member shown in FIG. 18A.
Figure 18D:
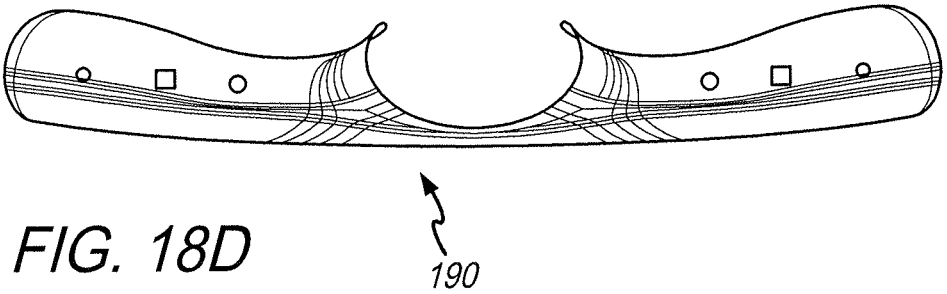
FIG. 18D is a bottom plan view of the skin support member shown in FIG. 18A.
Figure 19A:
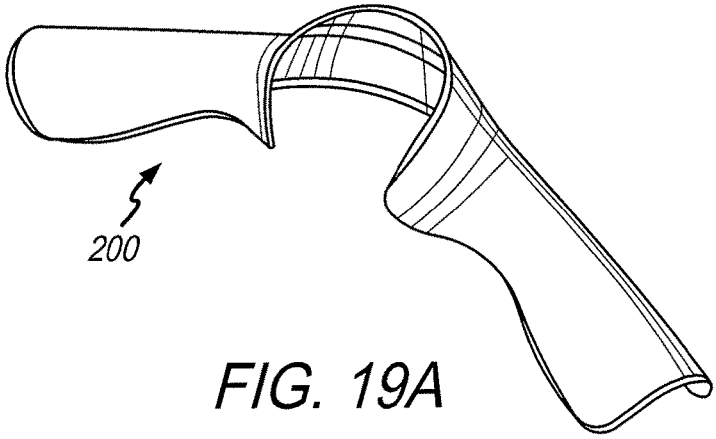
FIG. 19A is a perspective view of a skin support cover member that is a component of a clothing hanger according to other embodiments of the present invention.
Figure 19B:
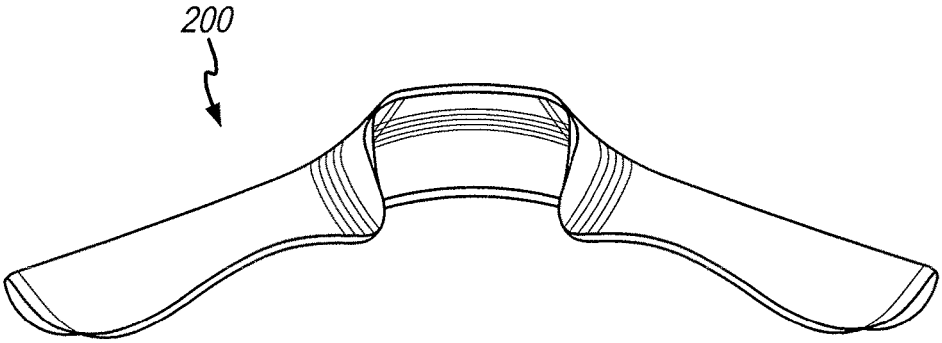
FIG. 19B is a front elevational view of the skin support cover member shown in FIG. 19A.
Figure 19C:
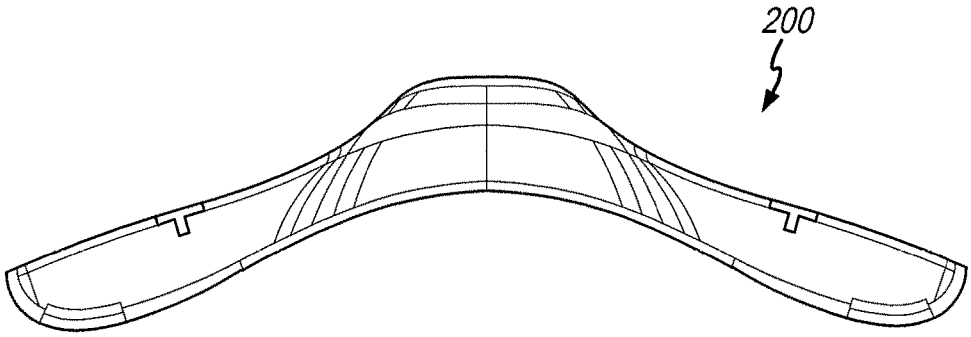
FIG. 19C is a rear elevational view of the skin support cover member shown in FIG. 19A.
Figure 19D:
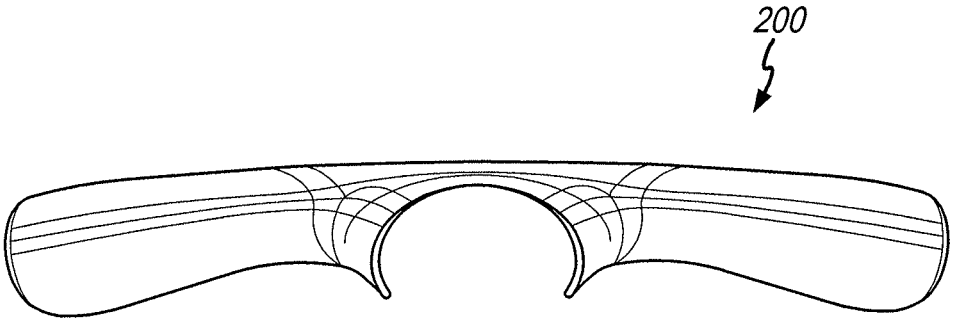
FIG. 19D is a top plan view of the skin support cover member shown in FIG. 19A.
Figure 19E:
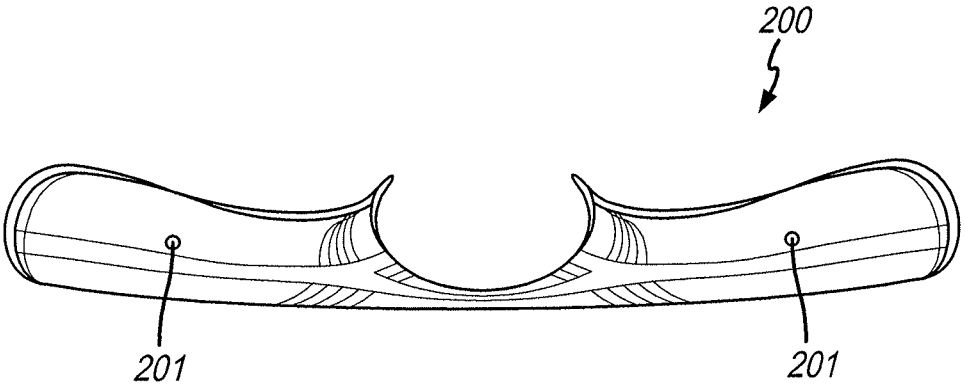
FIG. 19E is a bottom plan view of the skin support cover member shown in FIG. 19A.

Referring to FIGS. 9A-9C, a hook 20 includes a mounting structure 21 having a mounting surface 22. An opening or recess 23 is formed in mounting surface 22 for receiving post 14B of base member 10. Opening or recess 23, in the embodiment shown, includes a first section 23A of different diameter than second section 23B. Section 23A receives retaining member 14C of post 14B. Mounting surface 23 further includes a plurality of openings or recesses 24 for receiving projections 14D of mounting structure 14 of base member 10. Hook 20 is secured to base member 10 by inserting post 14B into opening or recess 23 so as to retain hook 20 on base member 10. Hook 20 is secured to base member 10 so as to be rotatable about post 14B. As hook 20 is rotated, projections 14D disengage from openings or recesses 24 until hook member 20 is rotated one-quarter turn, at which point projections 14D re-engage openings or recesses 24. This produces a positive stop so as to permit orientation of hook 20 in any one of four selected positions relative to base member 10. More or fewer projections 14D and openings or recesses 24 could be utilized to permit positioning of hook 20 as desired relative to base member 10.

Referring to FIGS. 3 and 10A-12D, one clothing hanger according to an embodiment of the present invention is shown that is primarily intended for use with men's suits. This embodiment includes a trouser bar 30, arm members 40, a skin support member 50 and a skin support cover member 60. Arm members 40 include a keyed projection 41 at one end thereof that is configured to mate with mounting structure 15 of base member 10 and a keyed projection 42 at the other end of arm members 40 that is configured to mate with correspondingly keyed openings or recesses (not shown) in the ends of trouser rod 30. Arm members 40 further include two bosses 33 having openings or recesses 34 therein for receiving projections (not shown) on skin support member 50. Skin support member 50 includes a plurality of openings or recesses 51 for receiving projections 61 on the underside of skin support cover member 60. Base member 10, hook 20, trouser bar 30, arm members 40, skin support member 50 and skin support cover member 60 may be assembled as shown in FIG. 3 to produce the clothing hanger shown.

FIG. 1 shows a clothing hanger primarily intended for use with men's shirts according to an embodiment of the present invention. This embodiment does not utilize a skin support member or skin support member cover. Rather, this embodiment only utilizes arm members 70 with base member 10 and hook 20. Arm members 70 are connected to base member 10 in the manner described above.

FIG. 2 shows a clothing hanger primarily intended for use with men's trousers according to an embodiment of the present invention. This embodiment does not utilize a skin support member or skin support member cover. Rather, this embodiment utilizes arm members 80 and a trouser bar 30. Arm members 80 are connected to base member 10 and trouser bar 30 in the manner described above. In the embodiment shown, trouser bar 30 is provided with clips 31. However, clips 31 are an optional feature of the hanger shown in FIG. 2.

FIGS. 13A-13D illustrate various views of a base member 110 that is a component of the clothing hangers shown in FIGS. 4-6. In the embodiment shown, base member 110 has a generally triangular configuration and includes a first arm 111, a second arm 112 and a third arm 113. Arms 111 and 112 meet at one end thereof at a mounting structure 114 for connecting a hook to base member 110, as described in greater detail below. Mounting structure 114 generally includes an upper surface 114A having a post 114B extending therefrom (FIG. 8). Post 114B, in the embodiment shown, includes a retaining member 114C of wider diameter than the remainder of post 114B. Upper surface 114 further includes a plurality of projections 14D extending therefrom. In the embodiment shown, there are four projections 114D. Projections 114D may be stationary members or may be moveable members, such as ball bearings.

The ends of first arm 111 and second arm 112 opposite mounting structure 114 each join with third arm 113 at a mounting structure 115 for connecting various arm members to base member 110, as described in greater detail below. Each mounting structure 115 includes an opening or recess 116 therein for receiving one end of various arm members. In the embodiment shown, opening or recess 116 is keyed or otherwise provided with structures designed to properly orient the various arm members with respect to base member 110 and to prevent rotation of the various arm members relative to base member 110.

Referring to FIGS. 14A-14D, a hook 120 includes a mounting structure 121 having a mounting surface 122. An opening or recess 123 is formed in mounting surface 122 for receiving post 114B of base member 110. Opening or recess 123, in the embodiment shown, includes a first section 123A of different diameter than second section 123B. Section 123A receives retaining member 114C of post 1148. Mounting surface 123 further includes a plurality of openings or recesses 124 for receiving projections 114D of mounting structure 114 of base member 110. Hook 120 is secured to base member 110 by inserting post 1148 into opening or recess 123 so as to retain hook 120 on base member 110. Hook 120 is secured to base member 110 so as to be rotatable about post 114B. As hook 120 is rotated, projections 114D disengage from openings or recesses 124 until hook member 120 is rotated one-quarter turn, at which point projections 114D re-engage openings or recesses 124. This produces a positive stop so as to permit orientation of hook 120 in any one of four selected positions relative to base member 110. More or fewer projections 114D and openings or recesses 124 could be utilized to permit positioning of hook 120 as desired relative to base member 110.

FIG. 4 shows a clothing hanger primarily intended for use with women's shirts according to an embodiment of the present invention. This embodiment includes arm members 170. Arm members 170 are connected to base member 110 in the manner described above.

FIG. 5 shows a clothing hanger primarily intended for use with women's trousers according to an embodiment of the present invention. This embodiment includes arm members 180 and a trouser bar 130. Arm members 180 are connected to base member 110 and trouser bar 130 in the manner described above. In the embodiment shown, trouser bar 130 is provided with clips 131. However, clips 131 are an optional feature of the hanger shown in FIG. 5.

Referring to FIGS. 6 and 15A-17C, one clothing hanger according to an embodiment of the present invention is shown that is primarily intended for use with women's shirts. This embodiment includes arm members 140, a skin support member 150 and a skin support cover member 160. Arm members 140 include a keyed projection 141 at one end thereof that is configured to mate with mounting structure 115 of base member 110. Arm members 140 further include two bosses 142 having openings or recesses 143 therein for receiving projections (not shown) on skin support member 150. Skin support member 150 includes a plurality of openings or recesses 151 for receiving projections 161 on skin support cover member 160. Base member 110, hook 120, arm member 140, skin support member 150 and skin support cover member 160 may be assembled as shown in FIG. 6 to produce the clothing hanger shown.

FIGS. 18A-18D and 19A-19E show alternative embodiments of a skin support member and skin support cover that can be utilized to produce a clothing hanger according to an embodiment of the present invention that is primarily intended for use with women's jackets. This embodiment also utilizes arm members 140. However, it uses a skin support member 190 and a skin support cover member 200 that differ in configuration from skin support member 150 and skin support member 160. Skin support member 190 includes a plurality of openings or recesses 191 for receiving projections 201 on skin support cover member 200. Base member 110, hook 120, arm members 140, skin support member 190 and skin support cover member 200 may be assembled as described above.

Various embodiments of the invention described above are discussed as being primarily intended for use with specific clothing types. The various dimensions of the components of those hangers have been selected to best accommodate those types of clothing items.

Although the invention has been shown and described in detail the same is by way of example and not be way of limitation. Numerous modifications can be made to the embodiments shown and described without departing from the scope of the invention.

What is claimed is:

1. A clothing hanger, including:

a base member having a first arm having a first end and a second end, a second arm having a first end connected to the first end of the first arm and a second end, a third arm having a first end connected to the second end of the first arm and a second end connected to the second end of the second arm, a first mounting structure adjacent the first end of the first arm and the first end of the second arm, the first mounting structure including a surface and a post extending from the surface, the post having a free end, a second mounting structure adjacent the second end of the first arm and the first end of the third arm, the second mounting structure including an opening and a third mounting structure adjacent the second end of the second arm and the second end of the third arm, the third mounting structure including an opening;

a hook having a mounting structure for engaging the first mounting structure of the base member and selectively securing the hook to the base member in multiple orientations with respect to the base member, the mounting structure of the hook including a surface having an opening and a closed end opposite the opening, the opening receiving the post of the first mounting structure such that the hook is rotatable about the post and the free end of the post is located between the surface of the mounting structure of the hook and the closed end;

a first arm member having a first end having a projection extending therefrom for engaging the opening in the second mounting structure to secure the first arm to the base member; and a second arm member having a first end having a projection extending therefrom for engaging the opening in the third mounting structure to secure the second arm to the base member.

2. The clothing hanger according to claim 1, further including an opening in the first arm member, a first support member having a projection for engaging the opening in the first arm member to secure the first support member to the first arm member, an opening in the second arm member, a second support member having a projection for engaging the opening in the second arm member to secure the second support member to the second arm member, an opening in the first support member, a first support cover member having a projection for engaging the opening in the first support member to secure the first support cover member to the first support member, an opening in the second support member, and a second support cover member having a projection for engaging the opening in the second support member to secure the second support cover member to the second support member.

3. A clothing hanger, including:

a base member having a first arm having a first end and a second end, a second arm having a first end connected to the first end of the first arm and a second end, a third arm having a first end connected to the second end of the first arm and a second end connected to the second end of the second arm, a first mounting structure adjacent the first end of the first arm and the first end of the second arm, a second mounting structure adjacent the second end of the first arm and the first end of the third arm, and a third mounting structure adjacent the second end of the second arm and the second end of the third arm;

a hook having a mounting structure for engaging the first mounting structure of the base member and securing the hook to the base member;

a first arm member having a first end and a second end, the first end of the first arm member configured to engage the second mounting structure of the base member to secure the first arm member to the base member;

a second arm member having a first end and a second end, the first end configured to engage the third mounting structure of the base member to secure the second arm member to the base member; and a rod having a first end with an opening therein and wherein the second end of the first arm member includes a projection configured to engage the opening in the first end of the rod to secure the rod to the first arm member.

4. The clothing hanger according to claim 3, wherein the first mounting structure includes a surface having a post extending therefrom.

5. The clothing hanger according to claim 4, wherein the mounting structure of the hook includes a surface having an opening for receiving the post of the first mounting structure.

6. The clothing hanger according to claim 5, wherein the post includes a retaining member.

7. The clothing hanger according to claim 6, wherein the opening in the mounting structure of the hook has a first section having a first diameter and a second section having a second diameter differing from the first diameter and wherein the second section receives the retaining member when the hook is connected to the base member.

8. The clothing hanger according to claim 5, wherein the hook is rotatable about the post.

9. The clothing hanger according to claim 8, wherein the surface of the first mounting structure includes a projection and the mounting structure of the hook includes a recess for receiving the projection to resist rotation of the hook about the post.

10. The clothing hanger according to claim 8, wherein the surface of the first mounting structure includes a plurality of projections and the mounting structure of the hook includes a plurality of recesses for receiving the projections to selectively position the hook in a plurality of orientations with respect to the base member.

11. The clothing hanger according to claim 3, wherein the second mounting structure of the base member includes an opening and the first end of the first arm member includes a projection for engaging the opening to connect the first arm member to the base member.

12. The clothing hanger according to claim 11, wherein the opening in the second mounting structure and the projection for engaging the opening in the second mounting structure are configured so as to permit the first arm member to be connected to the base member in only one orientation.

13. The clothing hanger according to claim 12, wherein the opening in the second mounting structure and the projection for engaging the opening in the second mounting structure are configured so as to prevent rotation of the first arm member when the first arm member is connected to the base member.

14. The clothing hanger according to claim 3, wherein the opening in the rod and the projection for engaging the opening in the rod are configured so as to prevent rotation of the rod when the rod is connected to the first arm member.

15. The clothing hanger according to claim 3, further including an opening in the first arm member and a support member having a projection for engaging the opening in the first arm member to secure the support member to the first arm member.

16. The clothing hanger according to claim 15, further including an opening in the support member and a support cover member having a projection for engaging the opening in the support member to secure the support cover member to the support member.

17. The clothing hanger according to claim 3, further including an opening in the first arm member located between the first and second ends of the first arm member and a support member having a projection for engaging the opening in the first arm member located between the first and second ends of the first arm member to secure the support member to the first arm member.

18. The clothing hanger according to claim 17, further including an opening in the support member and a support cover member having a projection for engaging the opening in the support member to secure the support cover member to the support member.

19. A clothing hanger, including:

a base member, a first arm member, a second arm member, a first support member, a second support member, a first support cover member, a second support cover member and a hook;

first means for connecting the first arm member to the base member;

second means for connecting the second arm member to the base member;

third means for fixedly connecting the first support member to the first arm member;

fourth means for fixedly connecting the second support member to the second arm member;

fifth means for connecting the first support cover member to the first support member;

sixth means for connecting the second support cover member to the second support member and seventh means for connecting the hook to the base member.

20. The clothing hanger according to claim 19, wherein the third means includes an opening in the first arm member.

21. The clothing hanger according to claim 19, wherein the third means includes a projection on the first support member.

22. The clothing hanger according to claim 19, wherein the fifth means includes an opening in the first support member.

23. The clothing hanger according to claim 19, wherein the fifth means includes a projection on the first support cover member.

24. A clothing hanger, including:

a base member having a first arm having a first end and a second end, a second arm having a first end connected to the first end of the first arm and a second end, a third arm having a first end connected to the second end of the first arm and a second end connected to the second end of the second arm, a first mounting structure adjacent the first end of the first arm and the first end of the second arm, a second mounting structure adjacent the second end of the first arm and the first end of the third arm, and a third mounting structure adjacent the second end of the second arm and the second end of the third arm;

a hook having a mounting structure for engaging the first mounting structure of the base member and securing the hook to the base member;

a first arm member having a first end and a second end, the first end of the first arm member configured to engage the second mounting structure of the base member to secure the first arm member to the base member;

a second arm member having a first end and a second end, the first end configured to engage the third mounting structure of the base member to secure the second arm member to the base member; and wherein the first mounting structure includes a surface having a post extending therefrom, the mounting structure of the hook includes a surface having an opening for receiving the post of the first mounting structure, the hook is rotatable about the post, the first mounting structure includes a projection, and the mounting structure of the hook includes a recess for receiving the projection to resist rotation of the hook about the post.

25. The clothing hanger according to claim 24, wherein the first mounting structure includes a plurality of projections and the mounting structure of the hook includes a plurality of recesses for receiving the projections to selectively position the hook in a plurality of orientations with respect to the base member.

26. A clothing hanger, including:

a base member having a first arm having a first end and a second end, a second arm having a first end connected to the first end of the first arm and a second end, a third arm having a first end connected to the second end of the first arm and a second end connected to the second end of the second arm, a first mounting structure adjacent the first end of the first arm and the first end of the second arm, a second mounting structure adjacent the second end of the first arm and the first end of the third arm, and a third mounting structure adjacent the second end of the second arm and the second end of the third arm;

a hook having a mounting structure for engaging the first mounting structure of the base member and securing the hook to the base member;

a first arm member having an opening, a first end and a second end, the first end of the first arm member configured to engage the second mounting structure of the base member to secure the first arm member to the base member;

a second arm member having a first end and a second end, the first end configured to engage the third mounting structure of the base member to secure the second arm member to the base member; and a support member having a projection for engaging the opening in the first arm member to secure the support member to the first arm member.

27. The clothing hanger according to claim 26, further including an opening in the support member and a support cover member having a projection for engaging the opening in the support member to secure the support cover member to the support member.

* * * * *